US005694651A

United States Patent [19]

Thomas

[11] Patent Number: 5,694,651

[45] Date of Patent: Dec. 9, 1997

[54] METHOD OF POSITION COLOR IDENTIFICATION FOR TEAM SPORTS AND SYSTEM

[76] Inventor: Paul J. Thomas, P.O. Box 2004, Cotuit, Mass. 02635

[21] Appl. No.: 356,632

[22] Filed: Dec. 15, 1994

[51] Int. Cl.[6] ..... A41D 1/04; A41D 13/00

[52] U.S. Cl. ..... 2/69; 2/115; 273/55 R; 434/247; 434/395; 446/26

[58] Field of Search ..... 2/46, 69, 69.5, 2/75, 80, 105, 106, 102, 115, 113, 114; 273/55 R, 411, 108.1, 108.3, 108.4; 434/247, 253, 257, 99, 395, 396; 446/26, 27, 28

[56] References Cited

U.S. PATENT DOCUMENTS

| | | | |
|---|---|---|---|
| 3,484,974 | 12/1969 | Culmone | 2/115 X |
| 3,580,573 | 5/1971 | Noonan | 273/55 |
| 4,078,265 | 3/1978 | Conduit . | |
| 4,277,848 | 7/1981 | Boehland . | |
| 4,296,498 | 10/1981 | Vinson | 2/115 |
| 4,453,274 | 6/1984 | Allen . | |
| 4,465,282 | 8/1984 | Dillon | 434/251 X |
| 4,602,387 | 7/1986 | Zakrzewski | 2/102 |
| 4,698,849 | 10/1987 | Mitchell et al. . | |
| 5,002,270 | 3/1991 | Shine | 2/102 |
| 5,014,359 | 5/1991 | Hanson | 2/102 X |
| 5,086,516 | 2/1992 | Baxter et al. | 2/102 X |
| 5,290,043 | 3/1994 | Vidinic | 273/411 |
| 5,325,538 | 7/1994 | Schoenweiss et al. | 2/102 X |
| 5,479,661 | 1/1996 | Fingleson et al. | 434/257 X |

OTHER PUBLICATIONS

Sports Illustrated, "New Grizzlies", Jul. 28, 1975, p. 18.

*Primary Examiner*—Jeanette E. Chapman
*Attorney, Agent, or Firm*—Thomas A. Kahrl, Esq.

[57] ABSTRACT

A position identification system for use in distinguishing individual team positions to aid in coaching in a multi-player athletic environment including sets of athletic over-vests which utilize different colors to identify selected positions in a pre-selected order and which employs a quick change, durable over-vest, adapted for any team sport that employs an offense and a defense consisting of more than one player per side, mainly football, basketball, baseball, hockey, volleyball, lacrosse, polo, field hockey, rugby and soccer wherein such sports are characterized by multi-teams, multi-positions and a plurality of players which are otherwise difficult to readily identify in the practice environment.

4 Claims, 6 Drawing Sheets

P-C VEST

THE OFFENSIVE PRACTICE

CONVENTIONAL

P-C VEST

THE DEFENSIVE PRACTICE

CONVENTIONAL

P-C VEST

THE KICK OFF

CONVENTIONAL

P-C VEST

THE KICK RETURN

CONVENTIONAL

P-C VEST

METHOD OF POSITION COLOR IDENTIFICATION FOR TEAM SPORTS AND SYSTEM

BACKGROUND OF THE INVENTION

Color identification has long been utilized in sports to differentiate opposing athletic teams utilizing a common playing field. In particular when a primary team is engaged in practice sessions involving a secondary team differentiation is important, especially where there is a large number of players. Furthermore in sports such as football, where fast play action is intended to fake and deceive the opposition team, rapid mass confusion occurs every time the ball is hiked. To help reduce the confusion for spectators, coaches and players alike, home team players typically wear colored jerseys with white numbers with the opposing visitors wearing white jerseys with colored numbers to assist in the differentiation between teams. During practice sessions it is common to employ a uniform team color to differentiate an offensive team from the defensive team, typically by giving the secondary team "red shirts" or vests to be worn over their normal jerseys to differentiate them from the primary team.

While color differentiation is helpful for players, it is essential for coaching in that it provides an important training tool for permitting a coach to distinguish teams and play action. In the past, in order to identify individual positions and players, coaches had to employ movie films or videos of practice sessions as well as games, in order to see what each player in each position was doing, whether out of position, whether in error or due to lack of skill. While identification of position player activity by means of movie or video is effective, it is also time consuming, expensive and inefficient in that it is not timely because it does not enable a coach to make on-the-spot identification of errors by a specific named player.

However, with color identification by position of each team player as contemplated in the present invention, an athletic team coach can identify problems in a practice environment with respect to the timing of play action, play execution, skill level and on-the-spot mistakes instantly and with increased accuracy.

PRIOR ART

Applicant is aware of prior art garments which are used for color identification, one such device is covered by U.S. Pat. No. 4,277,848 which is directed to an athletic jersey having a color changing panel. The panel is adapted to be unfolded and placed in a spread out condition on the body having a second color different from the color of the body portion of the athletic jersey to effectively change the color of the jersey. In essence this is an athletic jersey worn on the body of an athlete which has a panel which changes the color of the jersey for team identification. Another patent is U.S. Pat. No. 4,453,279 employing an upper body garment such as an athletic jersey having a characteristic color which may be changed so that a wearer, while participating in a team sport, may switch teams without having to change jerseys. This garment has a shell including front and rear panels having one color on the outside and another color on the inside, wherein the garment is attached together over the shoulders. Another patent is U.S. Pat. No. 4,078,275 dealing with an athletic jersey having a body portion having differing first and second panels in the front and rear respectively. The prior art devices are directed to changing the color of an athletic jersey. This patent is particularly directed toward form fitting jerseys used by female athletic team participants which permits change of the color without removal of the garment.

Accordingly, it is desirable to provide for a new and improved position color identification system for use in distinguishing individual team positions and individual players in a multi-player athletic environment to provide an on the spot training aid and method for coaching which overcomes at least some of the disadvantages of prior art.

SUMMARY OF THE INVENTION

The invention relates to a method of position color identification for team sports for distinguishing individual player positions in a multi-team athletic environment employing sets of athletic over-garment vests which utilize a plurality of different colors to identify player positions in a pre-selected order; and to a system employing the sets of over-garment vests. In particular, the invention concerns a player position identification system employing multiple sets of differently colored over-garment vests arranged in preselected order by player position, each vest employing a preselected color. Each over-garment vest incorporates a quick-release feature for rapid change of position identification adapted for sports teams that employ an offense and a defense consisting of more than one player per side. Such sports teams typically consist essentially of football, basketball, baseball, hockey, volleyball, lacrosse, polo, field hockey, rugby and soccer. These sports are characterized by multiple positions each position have different play action responsibilities and a plurality of players each of which are difficult to readily identify in the practice environment.

The vest over-garment is adapted to be folded flat having a fold line extending across the mid portion of the vest wherein the body portion consists of a torso encircling front portion and a torso encircling back portion fastened together along the bold seam extending across the shoulder wherein the material of the front and back panel consist of 100% polyester fishnet and each vest over-garment is constructed of a generally rectangular panel having a front side and a back side both of the uniform color constructed of fishnet. The front side includes a pair of outward facing quick-release fastening panels mounted at opposite corners with the back side having a pair of inward facing quick-release panels positioned at opposite corners such that when the panels are fastened together a head hole is formed the Position Color Identification is placed over the head of a player the head and helmet of the player pass easily through the head hole, and the first side encompasses the front of the player's upper torso and the back encompasses the back portion of the player's torso. Enlarged armholes are provided on opposite sides and the release fasteners may be engaged in cooperative fashion for a snug fitting over garment. The quick-release fasteners are of a durable tear-away design adapted to secure the front panel to the back panel but also to permit rapid disengagement without tearing the fabric of the colored vest to ensure durable extended wear.

The position color system of the present invention employs just a few color-keyed positions to permit a coach to identify each player by position, name, formation, alignment and area responsibility. Additionally, with this system a coach will be able to isolate missed assignments, mistakes, mismatches and keep players from unnecessary injury. By employing color-keyed positions, the Position Color Identification system essentially brings the chalkboard to the field to better identify the course of play and the players involved. In team sports such as football once play commences, the nature of the rapid-play action is intended to create rapid mass confusion every time the ball is put into play. However, by employing the Position Color Identification system to identify individual players and positions on offense as well as defense, it is possible to remove confusion, identify the problem, correct the problem and instill confidence in the players. Furthermore, it permits the coaches to be on top of the situation, to be able to call the players by name and instill confidence in the leadership of the team.

The present invention further provides a system for position identification of respective team positions consisting of a plurality of color identification sets, each set consisting of a plurality of differently colored position vests, "P-C Vests", consisting an over-garment constructed of 100% polyester fishnet for maximum durability having a v-neck design for easy on and off use with head gear such as helmets. Each vest includes a body portion adapted to be worn on the upper torso and includes a pair of tear-away, velcro front fastener to provide open armholes when wrapped around the upper body. The body portion consists of a selected substantially selected color and includes a front side and a back side both of the same uniform color.

THE CONCEPT

The Position Color Identification System maximizes the abilities of both coaches and team participanting athletes in the practice environment. With the use of position-color identification vests the team athlete will be able to grasp concepts and visualize adjustments at a higher level and faster rate and the team coaches will be able to identify team problems and individual player mistakes instantly with increased accuracy.

The Position Color Identification System can be used in any sport that has an offense and a defense consisting of more than one player per side, namely: football, basketball, baseball, hockey, volleyball, lacrosse, polo, field hockey, rugby and soccer. These sports consist of multi-teams, multi-positions, with several players which are difficult to readily identify in the practice environment.

The Position Color Identification System is a unique tool for hands-on instruction which employs a set of over-garments consisting of sets of individually colored vests with each vest constructed of 100% polyester fish net for maximum durability with a V-neck design for easy on-off use with head gear. In particular the vests feature tear away velcro fasteners for quick change and for extended wear.

With just a few colored keyed position vest the coaches can identify each player by position name, formation, alignment, and area of responsibility. In addition, the coaches will be able to isolate missed assignments, mistakes, mismatches and protect key players from unnecessary injury. With the Position Color Identification System employed on a selected team in practice session you can bring the chalkboard to the practice field.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
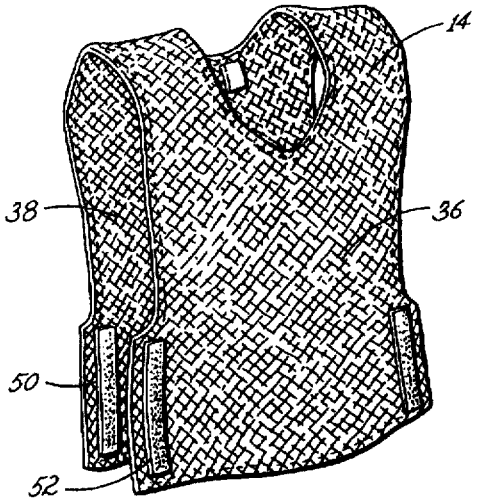
FIG. 1 is a perspective view of the position color vest according to the present invention.
Figure 2:
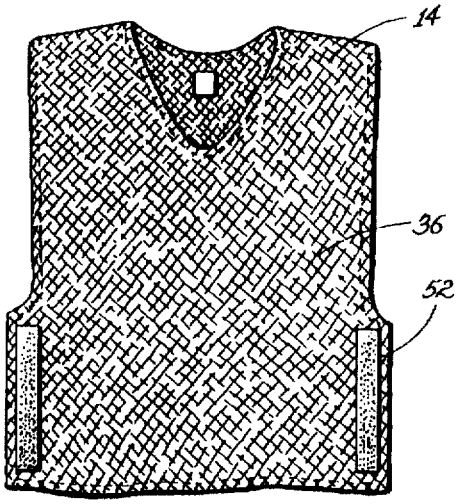
FIG. 2 is a front plan view of the position color vest shown in FIG. 1.
Figure 3:
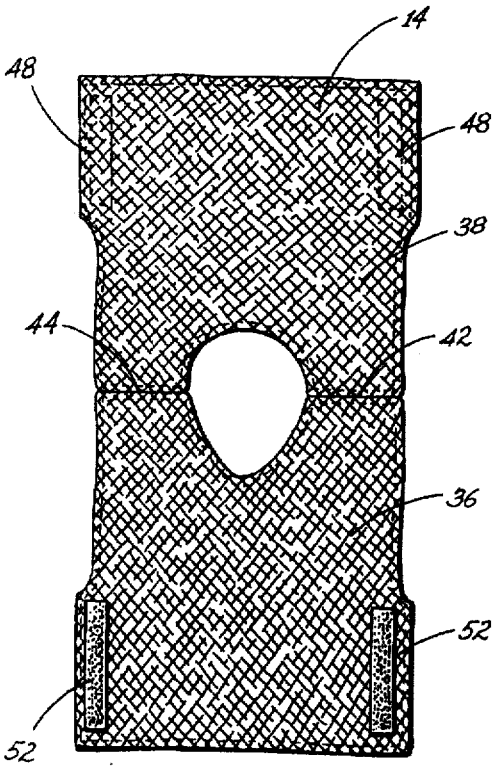
FIG. 3 is a top plan view of the position color vest of FIG. 1.

Referring to FIGS. 1–4, & 13 there is shown a team player 10 having a jersey 12 provided with a P-C Vest 14 having a unique color corresponding to a team position as is set forth hereinafter in a pre-selected order of color identification as is shown in FIGS. 5–12. This P-C Vest 14 consists of an over garment of uniform color both on the front panel 11 and on the back panel 13 and is configured to substantially cover the front of the jersey 12 as well as the back of said jersey to substantially enclose said jersey beneath the P-C Vest 14 and change the color identification of said team player. In the preferred embodiment, and as is displayed in the colored figures FIG. 5 through 12, the P-C Vest 14 is shown colored lime green color at 15, is shown colored banana yellow color at 16, is shown colored eggplant purple color at 17, is shown colored strawberry red color, at 18, is shown carrot orange color at 19 and is shown black and white striped at 20.

Figure 6:
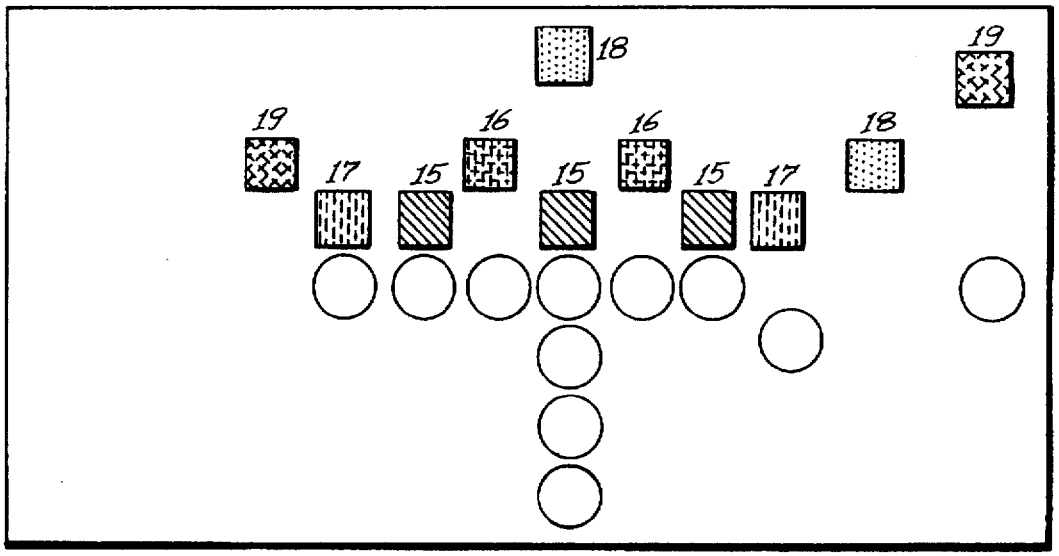
FIG. 6 is an illustrative football formation diagram in color showing defensive Position Color Identification according to the present invention.
Figure 7:
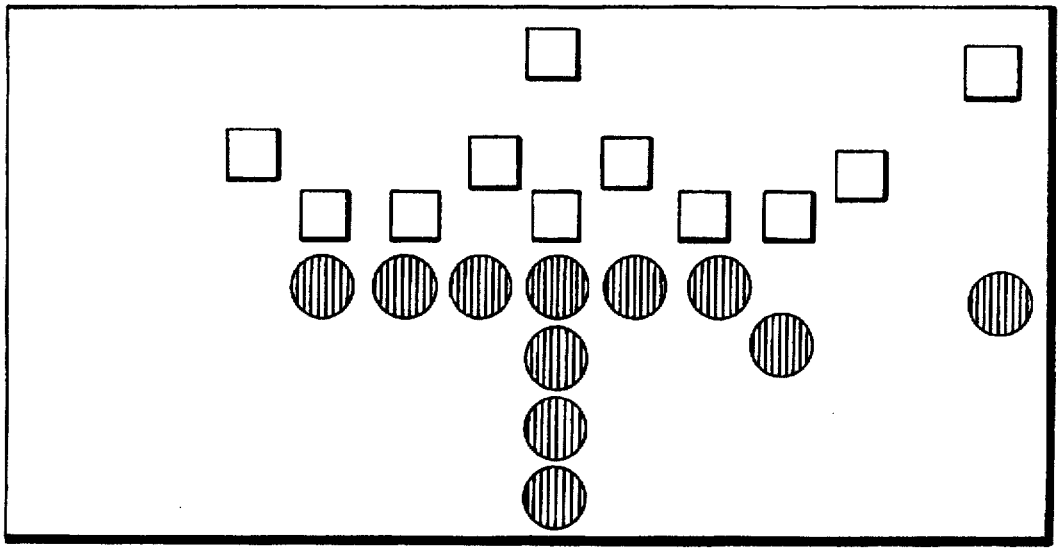
FIG. 7 is an illustrative football formation diagram in color showing conventional team color identification for offense with defensive practice in session.
Figure 8:
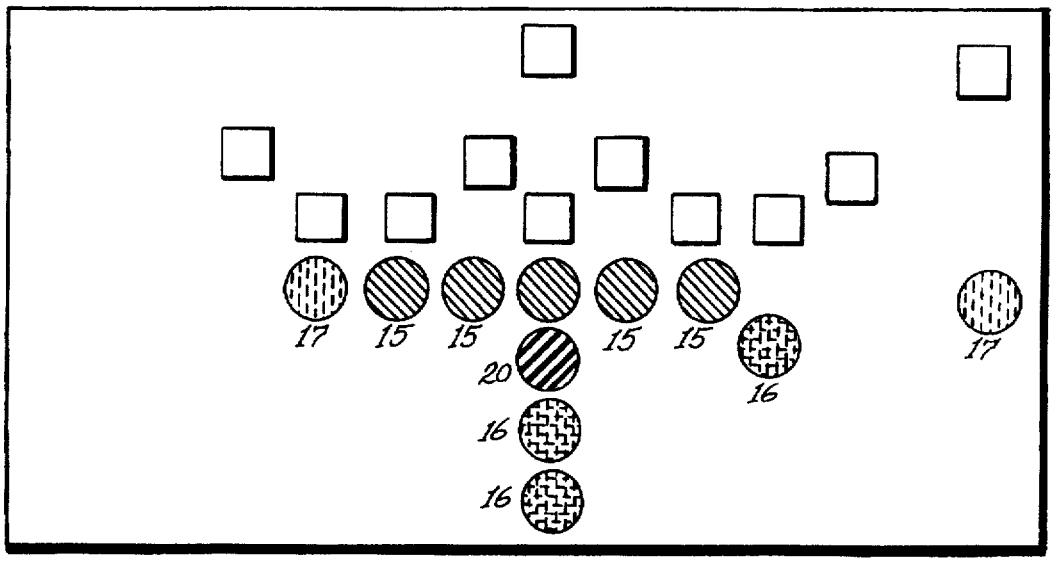
FIG. 8 is an illustrative football formation diagram in color showing offensive Position Color Identification according to the present invention.
Figure 9:
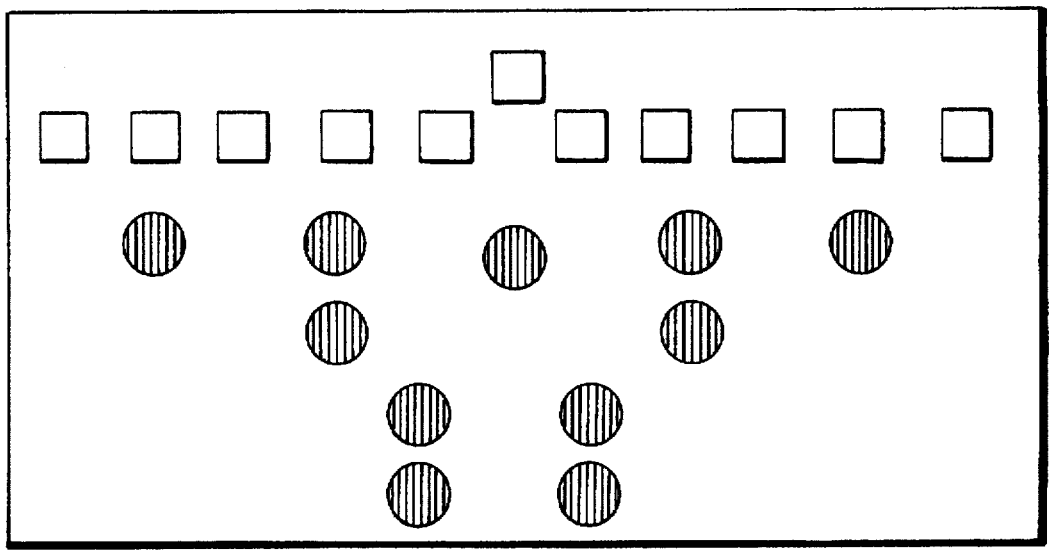
FIG. 9 is an illustrative football formation diagram in color showing conventional team color identification for kick off with red shirts receiving.
Figure 10:
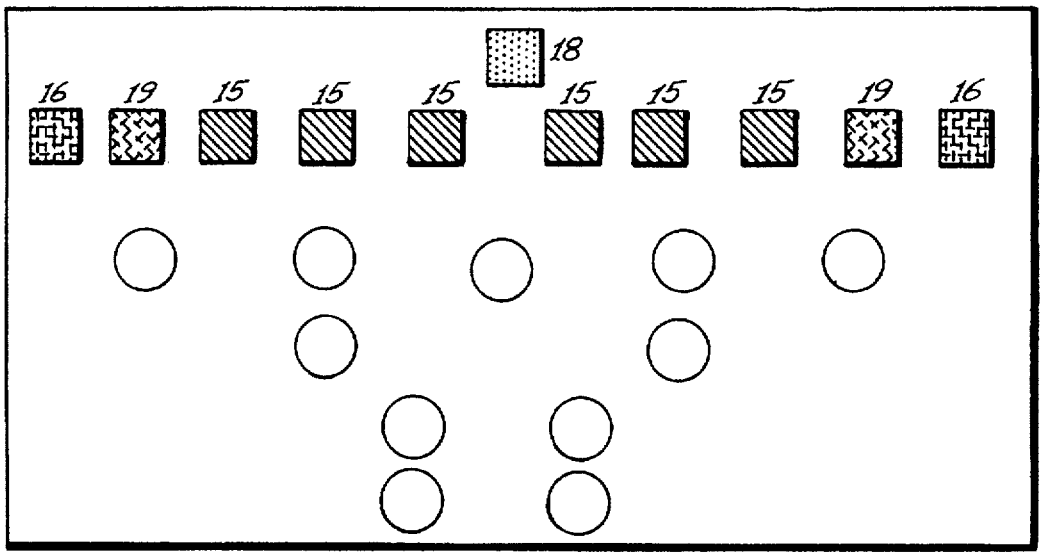
FIG. 10 is an illustrative football formation diagram in color showing kickoff Position Color Identification according to the present invention without additional identification needed on the receiving team.
Figure 11:
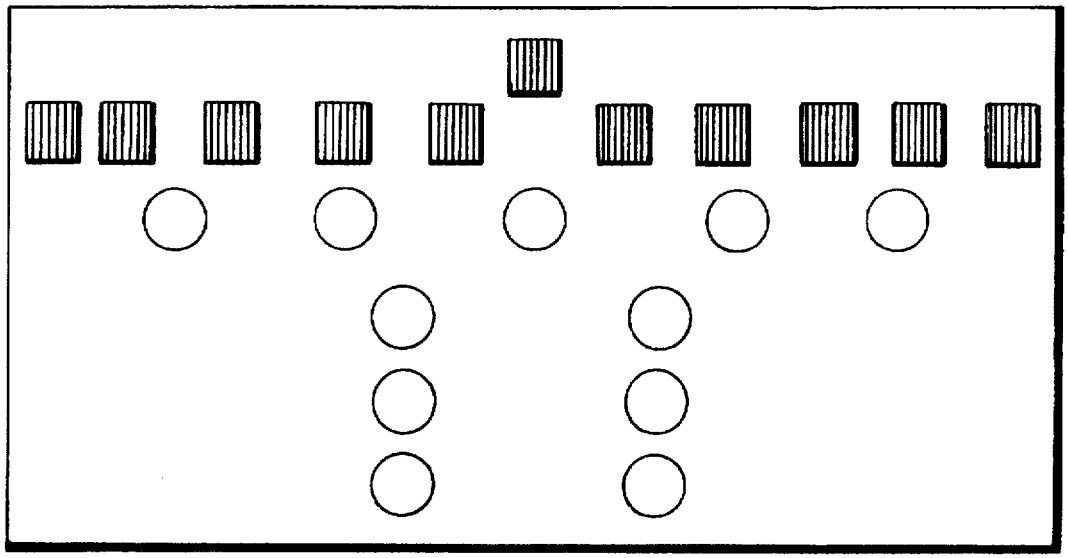
FIG. 11 is an illustrative football formation diagram in color showing conventional team color identification for kick return with red shirts on the kick-off team.
Figure 12:
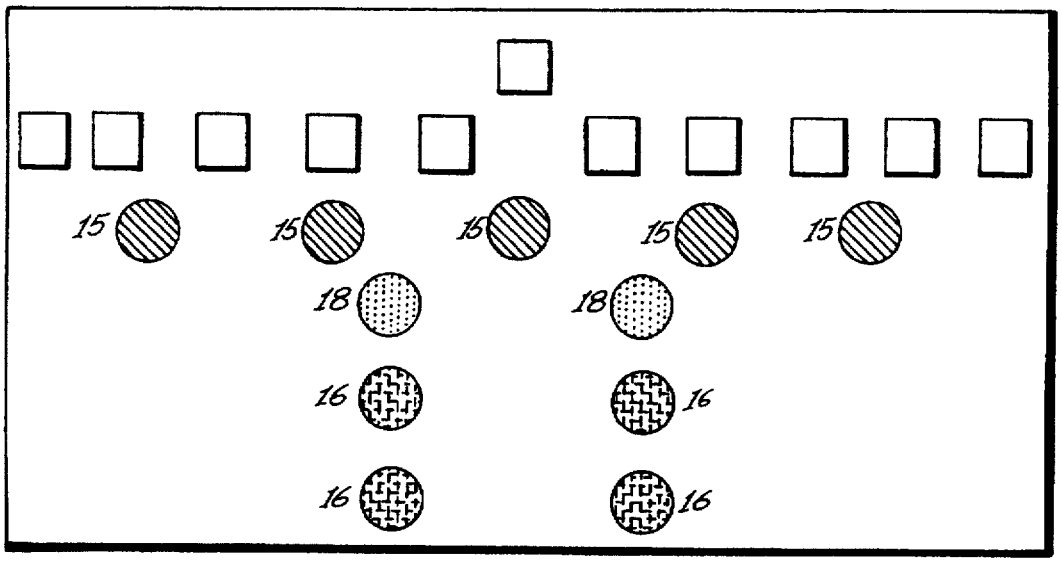
FIG. 12 is an illustrative football formation diagram in color showing return Position Color Identification according to the present invention without additional identification needed on the kick-off team.
Figure 13:
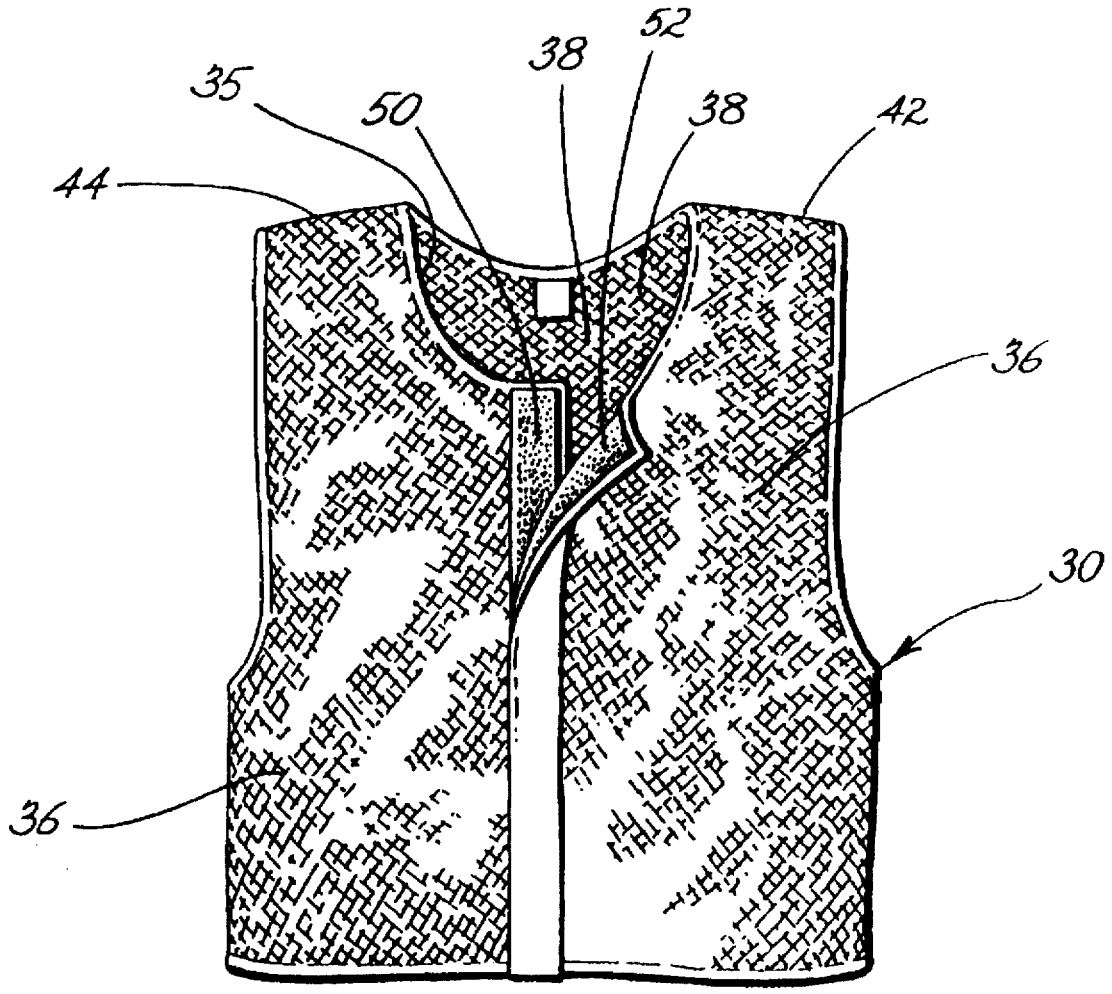
FIG. 13 is a perspective view of an alternate embodiment of the position color vest according to the present invention with front velcro fastener.

Referring to the FIGS. 5 through 12, FIG. 5 is an illustrative football formation diagram in color showing conventional team color identification for defense with offensive practice in session, while in FIG. 6 for comparison there is shown an illustrative football formation diagram in color showing the Position Color Identification system for defense according to the preferred embodiment. There is shown in FIG. 7 an illustrative football formation diagram in color showing conventional team color identification for offense with defensive practice in session, and for comparison in FIG. 8 there is shown an illustrative football formation diagram in color showing the offensive Position Color Identification system according to the preferred embodiment. There is further shown in FIG. 9 an illustrative football formation diagram in color showing conventional team color identification for kick off with red shirts receiving, and for comparison FIG. 10 shows an illustrative football formation diagram in color showing kickoff position-color identification according to the preferred embodiment without additional identification needed on the receiving team. Finally, as is shown in FIG. 11, there is shown an illustrative football formation diagram in color showing conventional team color identification for kick return with red shirts on the kick-off team and for comparison there is shown in FIG. 12 an illustrative football formation diagram in color showing return position-color identification according to the preferred embodiment without additional identification on the kick-off team.

Figure 4:
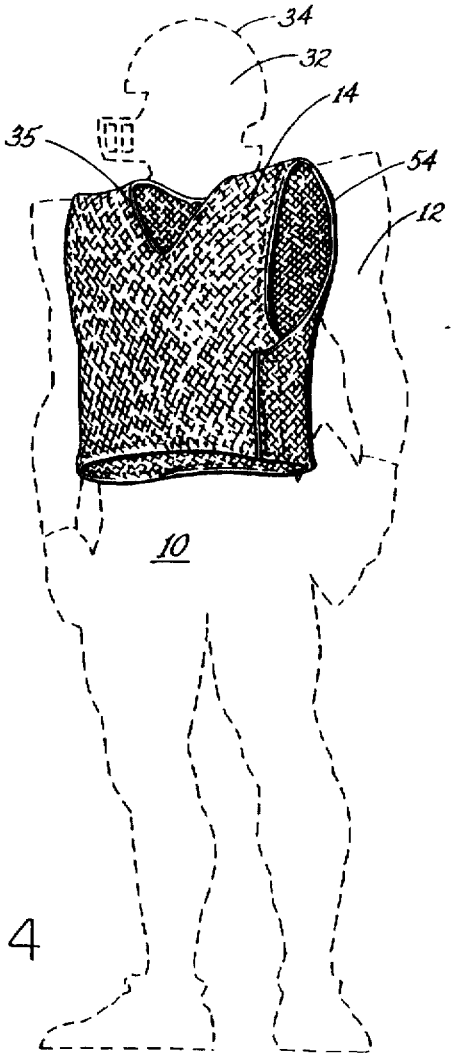
FIG. 4 is a front perspective view of the position color vest shown in FIG. 1 illustrated in place on the figure of a football athlete displaying the position color vest fitted over the shoulder pads and jersey portion.
Figure 5:
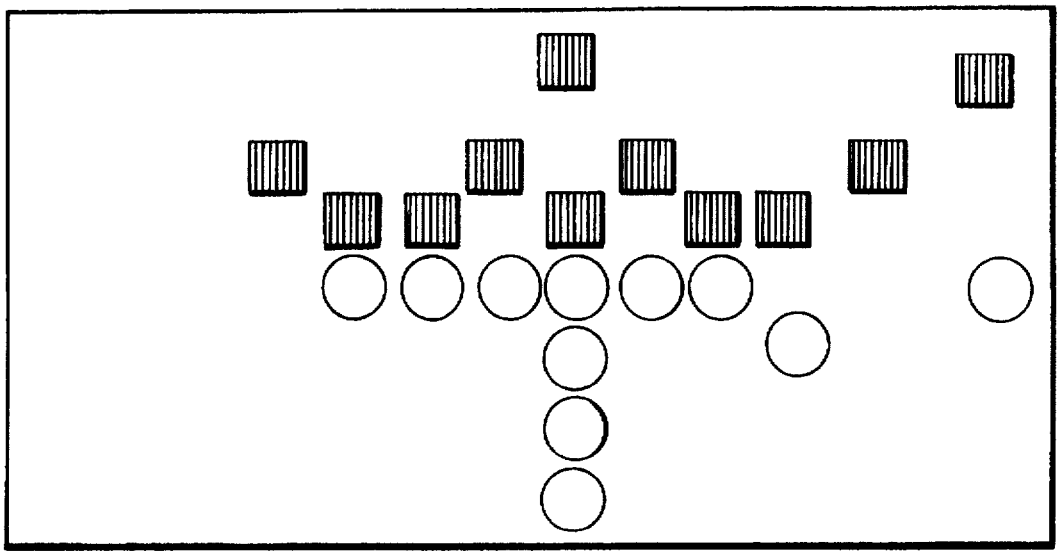
FIG. 5 is an illustrative football formation diagram in color showing conventional team color identification for defense with offensive practice in session.

As practiced in the preferred embodiment, P-C Vest 14 is worn by team player 10 as shown in FIG. 4 by drawing the PC-panel 30 over the player's head 32 typically employing a helmet 34; thus, a v-neck opening 35 of said P-C Vest passes over said helmet whereby front panel 36 hangs down over a front segment of jersey 12 and back panel 40 hangs down over the back of the jersey 12. In this manner said PC-Vest 14 being supported along seams 42 and 44 extending horizontally across the team player's shoulders 46.

Typically the jersey 12 is worn over the player's appropriate pads such as shoulder pads for football. As worn in this manner, rear panel fasteners 48, having inward facing fastener panels 50, may be laid on top of outward facing front panel fasteners 52 and be compressed together to provide a secure fit and provide large armholes 54 for arms and padding.

When it is desired to alter the color identification of team player 10, a first P-C Vest 15 of lime green color is simply removed by releasing said side fasteners and drawing said P-C Vest over the head 32 of said player having said P-C Vest replaced by a different position color vest i.e., P-C Vest 16 having a different color i.e., banana yellow color position. Thereby, any member of a team can readily change his/her color identification simply by detaching one P-C Vest and donning a second P-C Vest having a different color or, alternatively, removing said vest and exposing the underlying jersey 12.

In the preferred embodiment there is employed a new method of Position-color identification which is a new instructional application employing a visual learning process. Building on the original concept of dressing practice players in two different colors to distinguish two different teams, we have applied the Position Color Identification method incorporating P-C Vests 14.

In this method; by employing multi-color identification, we distinguish not only the teams but positions as well, thus enhancing instruction capabilities. It is understood that the colors may be varied from the preferred embodiment and be within the scope thereof, i.e. the colors used in this system can be any primary or secondary color, or any mix of each, in order to create the required effect. Black and white although not considered a color will also be included.

FOOTBALL EXAMPLE

This system is demonstrated in the color FIGS. 5 through 12 for the game of Football for two reasons. First, in this game there are 22 players on the field for each play. Second, each play last an average of 5 seconds. To sum it up, we have rapid mass confusion every time the ball is put into play. By using the position-color identification system we remove confusion, identify the problem, correct the problem and instill confidence.

In Football we really have four teams in one:

the offense the defense the kickoff the return

The colors we have assigned to positions of each team are as follows:

| COLOR | OFFENSE | DEFENSE | KICK OFF | KICK RETURN |
|---|---|---|---|---|
| LIME | LINEMAN | LINEMAN | LANE | LINE |
| BANANA | BACK | BACKER | BALL | BACK |
| EGGPLANT | END | END | | |
| STRAWBERRY | | SAFETY | SAFETY | SECOND LINE |
| CARROT | | CORNER | CONTAIN | |
| BLACK & WHITE | | QB/PUNTER | KICKER | |

The number of P-C Vests needed in each color to complete a set consisting of the four teams in order to do any selected team would be the following:

| | |
|---|---|
| LIME (15) | 6 |
| BANANA (16) | 4 |
| STRAWBERRY (18) | 4 |
| CARROT (19) | 4 |
| EGGPLANT (17) | 4 |
| BLACK/WHITE (20) | 2 |
| TOTAL | 24 |

We will now show how the Position Color Identification applies to each.

R—RED (SCOUT TEAM) W—WHITE ( FIRST TEAM) THE OFFENSE (during offensive session the Position Color Identification Team is the defense)

With existing vest we show what the coaches will see when they line up.

```
        R         R
R     R   R     R
  R R   R   R R
  W W W W W W     W
        W     W
        W
        W
```

The team coach must determine if 11 players have done their job and typically has 5 seconds to do it, and if something goes wrong, who missed an assignment? Who was the defensive player that made the play?

Using the P-C VEST things become clearer.

```
        S         C
      B   B     S
C E L   L   L E
  W W W W W W     W
        W     W
        W
        W
```

The colors identify the position, the alignment identifies the defense play formation. This makes it clear who did what and who missed what. The coach won't have to ask if that was a backer or a lineman!

THE DEFENSE (during defensive session the Position Color Identification Team is the offense)

With existing vest we show what the coaches will see when the offense lines up.

```
        W         W
W     W   W     W
  W W   W   W W
  R R R R R R     R
        R     R
        R
        R
```

The coach must again determine what the 11 defensive players have done. Have they checked to the right alignment and coverage? Were stunts executed? Were pursuit angles correct?

Using the Position Color Identification makes it easy.

Again the colors identify the position, the position identifies the offense. By color identification, even at full speed, mistakes will be obvious.

```
        W         W
W     W   W     W
  W W   W   W W
  E L L L L L     E
      B/W   B
        B
        B
```

THE KICK OFF (during the Kick Off session the Position Color Identification Team is the Kick Off team)

Using existing vest we will show what the coaches will see when we line up the Kick Off team.

```
          W
W W W W W   W W W W W
  R   R   R   R   R
      R       R
        R   R
        R   R
```

As a coach I must now be able to watch the entire length and width of the field as we have spread our teams out in these formations.

Now using the Position Color Identification, players stand out rather then get lost.

```
          S
B C L L L   L L L   B
  R   R   R   R   R
      R       R
        R   R
        R   R
```

With the Position Color Identification the coaches will be able to follow the players on their assignments the entire field. For example the C position, commonly called "contain man", will be easy to find out of position by his distinctive color. If he is running in the middle of the field, he has made a potentially costly mistake easily spotted and corrected by his coach.

THE KICK RETURN (during the Kick Return session the Position Color Identification Team is the Kick Return team)

Using existing vest we will show what the coaches will see when we line up the Kick Return team.

```
            R
R R   R R   R   R R R R R
    W   W     W   W   W
        W     W
        W     W
        W     W
```

Again, as a coach I must be able to cover the entire field. With this amount of players spread over this area it would be difficult to see much.

Now using the Position Color Identification a coach can follow the players with ease.

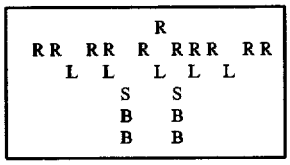

With the P-C VEST we can now separate the return players with little effort.

Along with the added advantage to the coaching staff, the players will also be able to visualize the concepts of offense, defense and special teams in less time allowing more time for perfecting techniques.

What is claimed is:

1. A method of distinguishing individual player positions by position color identification in a multi-team athletic environment for providing a training aid for coaching comprising the steps of:

a) establishing an offense and defense team;

b) providing sets of athletic vest utilizing different colors and assigning a selected color to a different position of each team; and

| COLOR | OFFENSE | DEFENSE | KICK-OFF | KICK-RETURN |
|---|---|---|---|---|
| LIME | LINEMAN | LINEMAN | LANE | LINE |
| BANANA | BACK | BACKER | BALL | BACK |
| EGGPLANT | END | END | | |
| STRAWBERRY | | SAFETY | SAFETY | SECOND LINE |
| CARROT | | CORNER | CONTAIN | |
| BLACK & WHITE | QB/PUNTER | | KICKER | |

c) clothing each team player with a selected colored vest to identify player positions enabling coaches and participating team members to grasp play action concepts and visualize adjustments and permit the coaches to identify team problems and individual mistakes on-the-spot with increased accuracy.

2. The method of claim 1 wherein the over-garment vests are worn as external overlays to game jerseys having quick release fasteners permitting a tight form fit together with fast changes over bulky athletic equipment without changing the jersey.

3. A color identification system for player position identification employing a combination of a jersey designating a team in addition to an overgarment designating player positions wherein each over-garment incorporates a quick-release feature for rapid change of position identification consisting of sets jerseys indicating the team and of individually colored vests for use in distinguishing individual team positions identifying player and for differentiation between sub-groups of player positions;

wherein over-garments comprise a plurality of multi-colored garments each over-garment comprising a shell member for embracing shoulder, upper back and chest area of a wearer, being open at the sides and having waist fasteners, said shell having a front panel and a rear panel, said panels being moveable between an open position and a secured position and having a characteristic color. wherein the team sport is identified as football and the player positions and the colors for each position are identified as:

4. The system of claim 3 comprising a plurality of multi-colored garments for a plurality of specialty teams wherein said teams comprise four specialty teams in one:

i) the offense;

ii) the defense;

iii) a kickoff team;

iv) a return team; and wherein the colors assigned to each position of each specialty team are as follows:

| COLOR | OFFENSE | DEFENSE | KICK OFF | KICK RETURN |
|---|---|---|---|---|
| LIME | LINEMAN | LINEMAN | LANE | LINE |
| BANANA | BACK | BACKER | BALL | BACK |
| EGGPLANT | END | END | | |
| STRAWBERRY | | SAFETY | SAFETY | SECOND LINE |
| CARROT | | CORNER | CONTAIN | |
| BLACK & WHITE | QB/PUNTER | | KICKER | |

and number of overgarments needed in each color to complete a set consisting of said four specialty teams would comprise:

| | |
|---|---|
| LIME (15) | 6 |
| BANANA (16) | 4 |
| STRAWBERRY (18) | 4 |
| CARROT (19) | 4 |
| EGGPLANT (17) | 4 |

-continued

| | |
|---|---|
| BLACK/WHITE (20) | 2 |
| TOTAL | 24 |

and the number of overgarments needed in each color to complete a team set consisting of said four specialty teams comprise lime green, banana yellow, strawberry red, eggplant purple, carrot orange, and striped, black and white.

* * * * *